US011512575B2

(12) United States Patent
Dikshit et al.

(10) Patent No.: US 11,512,575 B2
(45) Date of Patent: Nov. 29, 2022

(54) INFLOW CONTROL SYSTEM

(71) Applicant: SCHLUMBERGER TECHNOLOGY CORPORATION, Sugar Land, TX (US)

(72) Inventors: Ashutosh Dikshit, Houston, TX (US); Glenn Woiceshyn, Calgary (CA); Amrendra Kumar, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/791,123

(22) Filed: Feb. 14, 2020

(65) Prior Publication Data

US 2021/0215029 A1 Jul. 15, 2021

Related U.S. Application Data

(60) Provisional application No. 62/960,760, filed on Jan. 14, 2020.

(51) Int. Cl.

| | |
|---|---|
| ***E21B 43/24*** | (2006.01) |
| ***E21B 43/08*** | (2006.01) |
| ***E21B 43/38*** | (2006.01) |

(52) U.S. Cl.

CPC ..... *E21B 43/38* (2013.01); *E21B 43/08* (2013.01); *E21B 43/2406* (2013.01)

(58) Field of Classification Search

CPC ..... E21B 43/12; E21B 43/2408; E21B 34/08

See application file for complete search history.

(56) References Cited

U.S. PATENT DOCUMENTS

| | | | | |
|---|---|---|---|---|
| 2009/0229824 | A1* | 9/2009 | Ocalan | E21B 34/08 166/303 |
| 2011/0067878 | A1* | 3/2011 | Aadnoy | E21B 34/08 166/321 |
| 2012/0048561 | A1 | 3/2012 | Holderman | |
| 2012/0211243 | A1 | 8/2012 | Dykstra et al. | |
| 2013/0000897 | A1 | 1/2013 | Fang et al. | |

(Continued)

FOREIGN PATENT DOCUMENTS

| | | | |
|---|---|---|---|
| CN | 102747997 | A | 10/2012 |
| CN | 203640704 | U | 6/2014 |

OTHER PUBLICATIONS

International Search Report and Written Opinion issued in the PCT Application PCT/US2021/012087 dated Apr. 9, 2021 (13 pages).

*Primary Examiner* — Shane Bomar
(74) *Attorney, Agent, or Firm* — Michael Dae

(57) ABSTRACT

A technique facilitates the production of well fluid. According to an embodiment, an inflow assembly may be deployed downhole with, for example, completion equipment used in the production of well fluid. The inflow assembly comprises a first inflow control device and a second inflow control device disposed in series along a flow path routed between an exterior and an interior of the inflow assembly. As well fluid flows into an interior of the inflow assembly along the flow path, the first inflow control device and the second inflow control device perform different tasks with respect to controlling fluid flow. The different tasks may be selected to, for example, facilitate production of well fluid while protecting the completion equipment.

13 Claims, 2 Drawing Sheets

(56) References Cited

U.S. PATENT DOCUMENTS

| | | | | |
|---|---|---|---|---|
| 2013/0068467 | A1* | 3/2013 | Zhou | E21B 43/12 166/369 |
| 2014/0338922 | A1* | 11/2014 | Lopez | E21B 34/066 166/373 |
| 2015/0354330 | A1* | 12/2015 | Stahl | E21B 43/2406 166/254.1 |
| 2016/0061004 | A1* | 3/2016 | Tunkiel | E21B 43/12 166/373 |
| 2016/0369571 | A1* | 12/2016 | Banerjee | E21B 43/2406 |
| 2016/0369591 | A1* | 12/2016 | Vachon | E21B 43/12 |
| 2017/0089187 | A1* | 3/2017 | Hytken | E21B 36/005 |
| 2018/0045022 | A1* | 2/2018 | Woiceshyn | E21B 43/12 |
| 2019/0178068 | A1* | 6/2019 | Stolboushkin | E21B 33/1208 |
| 2020/0011153 | A1* | 1/2020 | Fripp | E21B 43/12 |
| 2021/0172299 | A1* | 6/2021 | Fermaniuk | E21B 43/08 |

* cited by examiner

INFLOW CONTROL SYSTEM

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/960,760, filed Jan. 14, 2020, the entirety of which is incorporated by reference herein and should be considered part of this specification.

BACKGROUND

In many well applications, a borehole is drilled into a subterranean formation and subsequently completed with completion equipment to facilitate production of desired well fluids, e.g. oil and gas, from a reservoir. Sometimes such subterranean well fluids are heavy and/or viscous which makes production difficult. To facilitate production, a steam assisted gravity drainage (SAGD) system may be employed. An SAGD system has a steam injector wellbore running parallel with and above and oil producer wellbore. High temperature steam is pumped into the injector wellbore and out into the surrounding formation so that the high temperatures may reduce the viscosity of oil in the surrounding formation. By lowering the oil viscosity, the oil is able to drain into the lower producer wellbore for production to the surface. In such a well, the intention is to produce an oil-water emulsion as the steam and gas front moves down towards the producer wellbore. However, if the steam progresses too far it can be detrimental to the completion equipment.

SUMMARY

In general, a system and methodology are provided to facilitate the production of well fluids. According to an embodiment, an inflow assembly may be deployed downhole with, for example, completion equipment used in the production of a well fluid. The inflow assembly comprises a first inflow control device and a second inflow control device disposed in series along a flow path routed between an exterior and an interior of the inflow assembly. As a well fluid flows into an interior of the inflow assembly along the flow path, the first inflow control device and the second inflow control device perform different tasks/functions with respect to controlling fluid flow. The different tasks/functions may be selected to, for example, facilitate production of well fluid while protecting the completion equipment.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
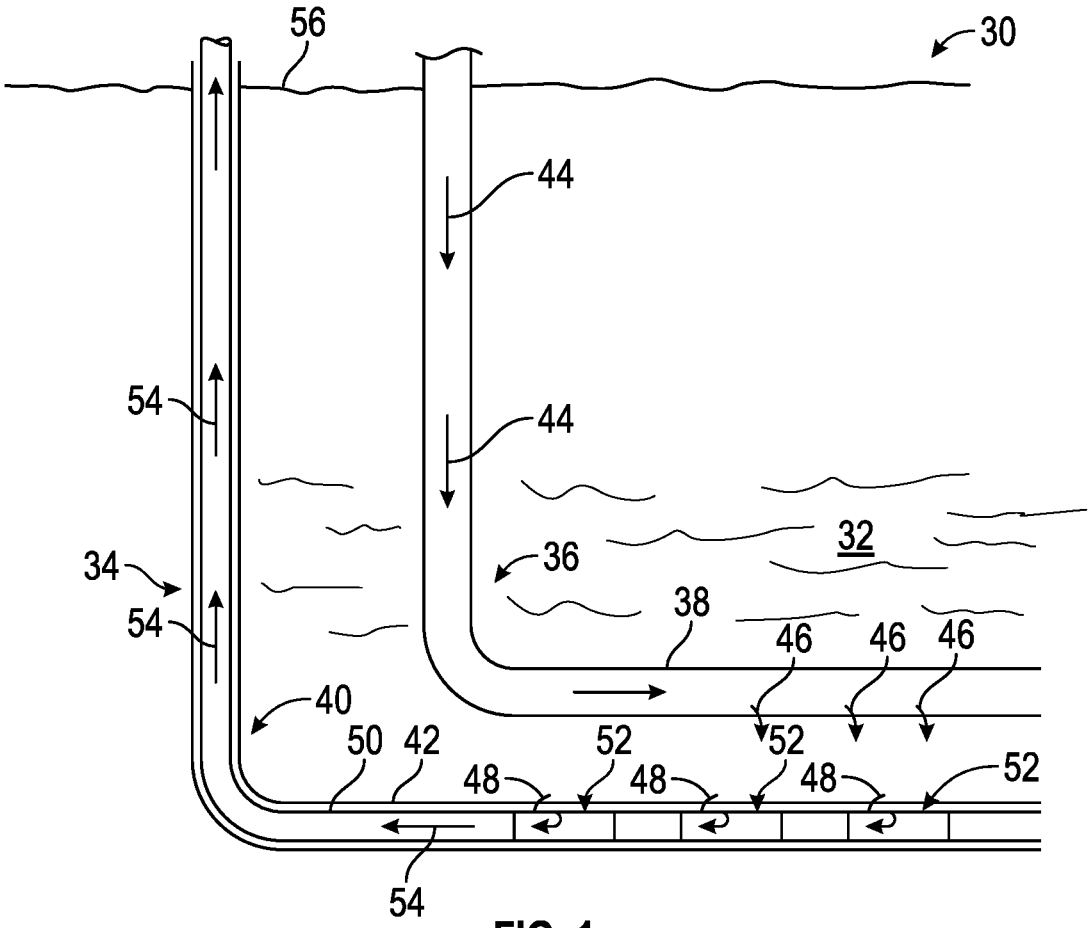
FIG. 1 is a schematic illustration of a plurality of inflow assemblies positioned along a completion string in a production wellbore of a steam assisted gravity drainage system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating production of well fluid while protecting completion equipment in a variety of well production systems, e.g. an SAGD system. According to an embodiment, an inflow assembly may be deployed downhole with, for example, completion equipment used in the production of a well fluid. In some applications, a plurality of inflow assemblies may be positioned along a completion string deployed in a wellbore, e.g. the oil production wellbore of an SAGD system.

The inflow assembly comprises a first inflow control device and a second inflow control device disposed in series along a flow path routed between an exterior and an interior of the inflow assembly. The interior of the inflow assembly is part of an overall interior production flow passage used to conduct the flow of produced fluids to a collection location, e.g. a surface collection location. As a well fluid flows into an interior of the inflow assembly along the flow path, the first inflow control device and the second inflow control device perform different tasks/functions with respect to controlling fluid flow. The different tasks/functions may be selected to, for example, facilitate production of well fluid while protecting the completion equipment. The different functionality between the inflow control devices may be achieved by using different types of inflow control devices, e.g. different sizes, configurations, orientations, materials, and/or other features to achieve the desired difference in performance.

Although first and second inflow control devices are described herein for purpose of explanation, additional inflow control devices may be utilized in a given inflow assembly. When the at least two inflow control devices are positioned in series, the at least two inflow control devices are able to conduct fluids in the same streamline. Well fluid, for example, is able to flow from an inlet of the first inflow control device to an outlet of the first inflow control device and then continue flowing to an inlet of the second inflow control device and then to exit from an outlet of the second inflow control device (and onto subsequent inflow control devices if more than two are employed).

Depending on the embodiment, the inflow control devices may be incorporated into a variety of inflow assemblies, such as sand screens, sliding sleeves, and/or other well completion devices or systems. Drilling logs and/or other a priori knowledge of the well can be used to select the sizes and/or other parameters of the inflow control devices and the systems incorporating those inflow control devices. Additionally, the inflow assembly and corresponding inflow control devices may be used in a variety of well systems, such as SAGD systems.

In an SAGD system, for example, high temperature steam pumped into the injector well may be used to reduce oil viscosity to improve production through the producer well located below the injector well. When an SAGD operation is initiated, the high temperature steam cools somewhat as the steam and gas front moves down towards the producer well and ends up producing an oil-water emulsion. However, the plural inflow control devices positioned in series in the corresponding inflow assembly cooperate to choke back hot water and live steam to protect the completion string. It should be noted that the emulsion being produced is at a very high temperature and the temperature keeps rising over time as the water/steam front continues to drop toward the producer well. Accordingly, the plural inflow control devices also may be used to choke back gas when, for example, live steam is forcing its way down during a blow down stage (which is typically encountered towards the end of life of a given producing zone in the subterranean formation).

In an SAGD application, the two (or more) inflow control devices may be positioned in series along a flow path routed between an exterior and an interior of the corresponding inflow assembly located in the production well. The first inflow control device may comprise a nozzle having a converging throat which creates a pressure drop before the throat area. The pressure drop causes the high temperature, high pressure water moving down into the production well to lose pressure which, in turn, causes the water to convert into steam and form bubbles. These bubbles effectively cause another pressure drop so that the nozzle is able to choke back the flow because of the low flow coefficient. Basically, the pressure drop causes flashing to occur ahead of the nozzle throat so that the flow is choked.

In this example, the second inflow control device also may comprise a nozzle located in series and downstream of the first inflow control device. In some embodiments, the nozzle of the second inflow control device may be a self adjusting nozzle which selectively restricts gas. The second inflow control device is thus able to act as a secondary barrier in an SAGD application. During the blow down stage, for example, the converging nozzle of the first flow control device may not be able to stop steam as its flow coefficient is very high. However, the nozzle, e.g. a self adjusting nozzle, of the second inflow control device is able to choke back the flow and thus effectively manage blow down as well. An example of a self adjusting nozzle is the ResAdvance nozzle available from Schlumberger Corporation.

Referring generally to FIG. 1, an example of a well system 30 is illustrated for use in producing a well fluid, e.g. oil, from a subterranean formation 32. In this example, the well system 30 comprises an SAGD system 34 having a steam injector well 36 with a generally lateral section of injector wellbore 38. The SAGD system 34 also comprises an oil production well 40 having a generally lateral section of production wellbore 42 which may be oriented generally parallel with and positioned below the corresponding lateral injector wellbore 38.

Steam, as represented by arrows 44, is directed down through appropriate injection equipment located in the steam injector well 36. This hot steam flows into the surrounding formation 32 as represented by arrows 46. The high temperature steam reduces the viscosity of oil located in the surrounding formation 32 so the oil can flow down to the oil production well 40. The heated oil joins with the steam to form a well fluid in the form of an oil-water emulsion which flows at a high temperature and pressure as a front down to the producer well 40.

The well fluid enters the producer well 40 as represented by arrows 48. Specifically, the well fluid enters a completion string 50 located in the oil production well 40 via an inflow assembly or assemblies 52. As explained in greater detail below, each inflow assembly 52 comprises a plurality of inflow control devices which protect the completion equipment of completion string 50 by preventing influx of the high temperature steam. The well fluid is then able to flow up through completion string 50, as represented by arrows 54, to a desired collection location which may be at surface 56.

Figure 2:
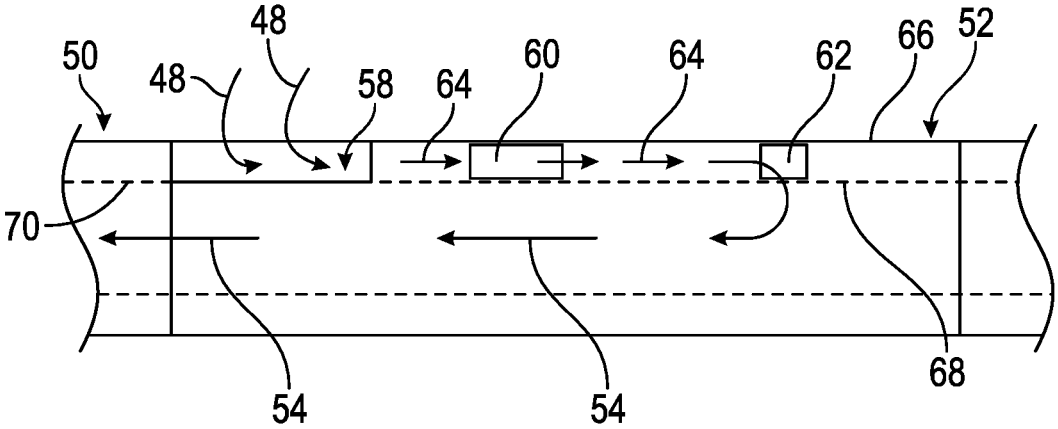
FIG. 2 is a schematic illustration of an example of one of the inflow assemblies illustrated in FIG. 1, according to an embodiment of the disclosure.

Referring generally to FIG. 2, a schematic example of one of the inflow assemblies 52 is illustrated. In this example, the inflow assembly 52 is positioned along the completion string 50 and comprises an inflow region 58 through which the well fluid enters the inflow assembly 52 as represented by arrows 48. The inflow assembly 52 also comprises a first inflow control device 60 located downstream of the inflow region 58 and a second inflow control device 62 located in series with first inflow control device 60 and downstream of first inflow control device 60. In the example illustrated, both the first inflow control device 60 and the second inflow control device 62 may be in the form of flow restrictors.

The first inflow control device 60 and the second inflow control device 62 are located along a flow path 64 which effectively is routed from an exterior 66 of inflow assembly 52 to an interior 68 of inflow assembly 52. The interior 68 may be part of an overall interior production flow passage 70 along which well fluid is produced up through completion string 50 to the surface 56 (see arrows 54).

To facilitate control over fluid flow into inflow assembly 52 and to limit the inflow of steam, the second inflow control device 62 is of a different type than the first inflow control device 60. For example, the inflow control devices 60, 62 may have different sizes, configurations, orientations, materials, and/or other features to provide the inflow control devices 60, 62 with different functionalities relative to each other. For example, the inflow control devices 60, 62 may be configured to limit or block the flow of different types of fluids or to provide different techniques for blocking similar fluids.

Figure 3:
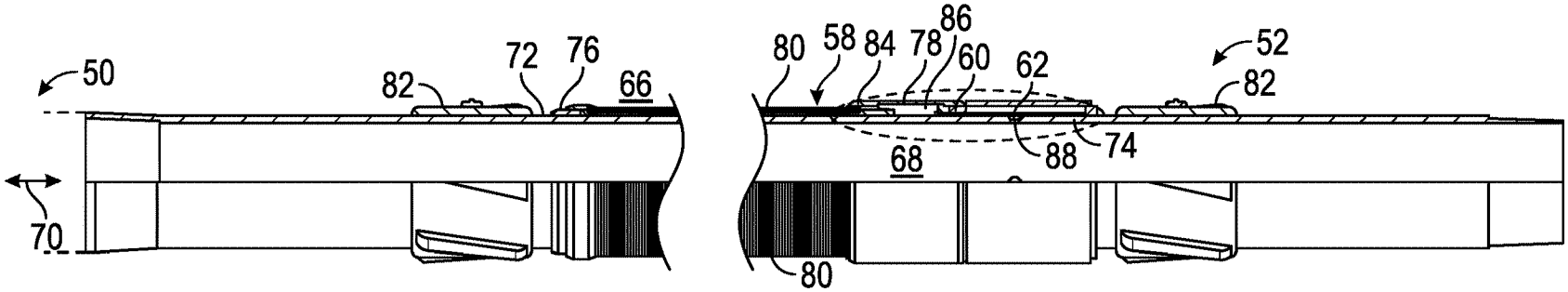
FIG. 3 is a partial cross-sectional view of an example of one type of inflow assembly comprising a plurality of inflow control devices, according to an embodiment of the disclosure.

Referring generally to FIG. 3, another example of the inflow assembly 52 is illustrated as deployed along a completion string 50. In this embodiment, the inflow assembly 52 comprises an inner tubular member 72, e.g. a base pipe, having a tubular member wall 74 which defines the interior 68. As discussed above, interior 60 forms part of the overall interior production flow passage 70. By way of example, the tubular member 72 may be in the form of a tubing joint which can be coupled into the completion string 50.

The illustrated inflow assembly 52 further comprises an inflow assembly body 76 which defines inflow region 58 and is coupled with an assembly housing 78 generally enclosing first inflow control device 60 and second inflow control device 62. In some embodiments, a sand screen 80 may be mounted around inflow region 58 to help remove particulates from the inflowing well fluid during operation. The body 76 and housing 78 may be secured at a desired location along inner tubular member 72 via appropriate coupling members 82, e.g. end rings.

During operation, well fluid flows in through sand screen 80 and along suitable regions or passageways 84 until entering an annulus 86 formed between the exterior of tubular member 72 and the interior of assembly housing 78. The inflowing well fluid then moves through first inflow control device 60 and subsequently through the second inflow control device 62 which is located in series and downstream of first inflow control device 60.

In this example, the second inflow control device 62 is mounted an opening 88 which may be formed generally radially through the wall 74 of inner tubular member 72. Thus, as the inflowing well fluid moves through second inflow control device 62, the well fluid moves into interior 68 and is produced to the surface up through interior production flow passage 70 of completion string 50. It should be noted, however, the inflow control devices 60, 62 may be positioned at a variety of locations and various ports may be used to direct the flow to interior 68.

Figure 4:
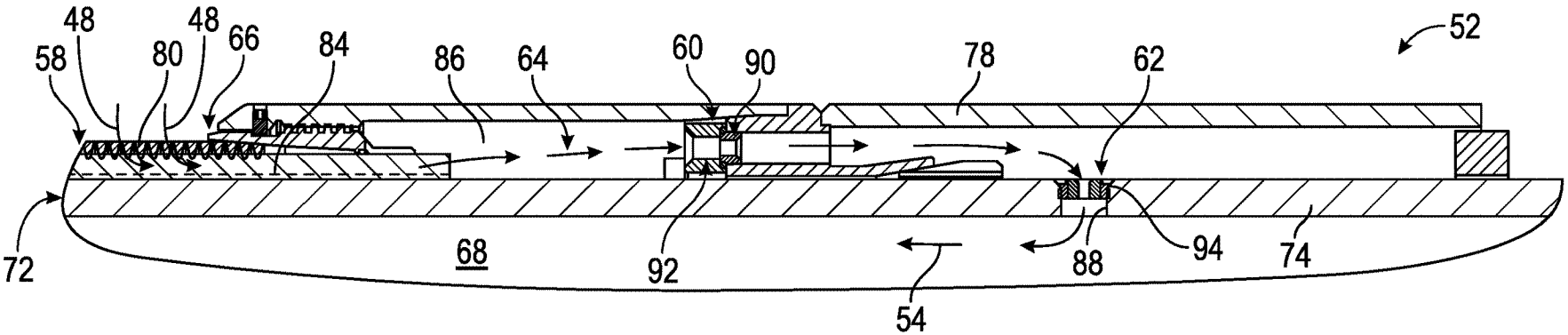
FIG. 4 is a cross-sectional illustration of a portion of the inflow assembly illustrated in FIG. 3 showing examples of a first type of inflow control device and a second type of inflow control device disposed in series, according to an embodiment of the disclosure.

With additional reference to FIG. 4, the first inflow control device 60 is a different type of device than the second inflow control device 62. According to an embodiment, the first inflow control device 60 may comprise a nozzle 90, e.g. a convergent divergent nozzle as illustrated. As also illustrated, the nozzle 90 may be oriented generally parallel with the inner tubular member 72.

The convergent divergent nozzle 90 has a converging section which converges to a throat 92. Throat 92 is sized to create a pressure drop ahead of the throat 92 during fluid flow, e.g. during inflow of the hot water-oil emulsion. The pressure drop, in turn, causes the high temperature, high pressure inflowing water of the water-oil emulsion to flash, e.g. bubble. As the steam flashes it is choked back via convergent divergent nozzle 90. In this example, the second inflow control device 62 also may be constructed to act as a choke but it may be configured to choke back gas to prevent the inflow of steam during, for example, a blow down stage when steam has been able to pass through the nozzle 90.

In some embodiments, the second inflow control device 62 also comprises a nozzle 94 which may be positioned in opening 88 through wall 74. By way of example, the second inflow control device 62/nozzle 94 may be an autonomous inflow control device, e.g. a self adjusting nozzle, such as the ResAdvance type of inflow control device available from Schlumberger Corporation.

During operation of an SAGD type system, the emulsion of oil and water flows through the inflow assembly 52 and up through production flow passage 70. As the temperature rises due to the steam injection, however, the water starts flashing ahead of nozzle 90 which causes nozzle 90 to choke back water. As the temperature continues to rise, the blow down stage is eventually reached. At this stage, steam may be able to pass through nozzle 90 but that steam is choked back via autonomous nozzle 94. In other words, the two different types of nozzles 90, 94 are selected to function differently while cooperating to ensure unwanted hot water/steam does not enter the completion equipment of completion string 50. Thus, the use of serial inflow control devices 60, 62 can be used to effectively manage production from an SAGD well without compromising completion equipment which otherwise would have eroded due to the inflow of steam.

Depending on the parameters of a given application and equipment utilized, the inflow control devices 60, 62 are arranged in series but the flow path between the inflow control devices may vary. Furthermore, additional inflow control devices, e.g. additional nozzles, may be employed in series with the illustrated inflow control devices 60, 62. Other types of flow restrictors also may be used instead of nozzle 90 and/or nozzle 94 so long as the restriction is constructed to selectively restrict one fluid over another to thus choke off the unwanted fluid, e.g. steam. The overall system also may be constructed to redirect flow to another path once it senses certain temperatures or temperature differences in the produced fluid.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in producing well fluid, comprising:
- a steam injection well;
- an oil production well located at least in part below the steam injection well in a subterranean formation, the oil production well comprising a downhole completion string having an inflow assembly through which is received a well fluid for production to a surface location, the inflow assembly comprising:
  - an inflow region through which the well fluid enters the inflow assembly;
  - a first inflow control device located downstream of the inflow region and along a flow path extending from the inflow region to an interior production flow passage; and
  - a second inflow control device located along the flow path in series with and downstream of the first inflow control device, the second inflow control device being of a different type than the first inflow control device, wherein high temperature water flows into the oil production well as a result of steam injection into the steam injection well, the first inflow control device being configured to cause a pressure drop which causes the high temperature water to bubble, the second inflow control device being configured to restrict flow of gas therethrough, wherein the second inflow control device comprises a self adjusting nozzle.

2. The system as recited in claim 1, wherein the first inflow control device comprises a flow restrictor in the form of a first nozzle.

3. The system as recited in claim 1, wherein the interior production flow passage within the inflow assembly is defined by a tubular member and the second inflow control device is mounted in a wall of the tubular member.

4. The system as recited in claim 1, wherein the inflow assembly further comprises a sand screen mounted at the inflow region.

5. A system for use in a well, comprising:
- an inflow assembly for receiving well fluid for production, the inflow assembly comprising:
  - a first inflow control device, wherein the first inflow control device comprises a convergent divergent nozzle; and
  - a second inflow control device, the second inflow control device being located in series with the first inflow control device along a flow path through the inflow assembly, the second inflow control device being constructed to perform a different function than the first inflow control device, the second inflow control device comprising an adjustable nozzle which may adjust downhole to improve production of the well fluid.

6. The system as recited in claim 5, wherein the second inflow control device comprises an autonomous fluid control device.

7. The system as recited in claim 5, wherein the inflow assembly is located along a well completion through which the well fluid is produced to a surface location.

8. The system as recited in claim 7, wherein the inflow assembly is part of a steam assisted gravity drainage system.

9. The system as recited in claim 5, wherein the inflow assembly further comprises a sand screen located upstream of the first inflow control device.

10. The system as recited in claim 5, further comprising additional inflow assemblies, the inflow assembly and the additional inflow assemblies being located along a downhole completion string.

11. A method, comprising:

providing an inflow assembly with a flow path between an exterior and an interior of the inflow assembly;

positioning a first inflow control device and a second inflow control device in series along the flow path;

conveying the inflow assembly downhole into a wellbore to enable an inflow of well fluid along the flow path from the exterior to the interior of the inflow assembly;

utilizing the first inflow control device to control inflow of a first type of fluid and the second inflow control device to control inflow of a second type of fluid; and enabling adjustment of the second inflow control device during inflow of the well fluid to enhance production of the well fluid;

wherein utilizing comprises using the first inflow control device to cause a pressure drop which converts high temperature water, in the well fluid, into steam and using the second inflow control device to restrict flow of gas therethrough.

12. The method as recited in claim 11, wherein conveying comprises conveying the inflow assembly into a production well of a steam assisted gravity drainage system.

13. The method as recited in claim 11, wherein providing comprises providing a plurality of inflow assemblies along a completion string.

* * * * *